US005407156A

United States Patent [19]

Rossman et al.

[11] Patent Number: 5,407,156

[45] Date of Patent: Apr. 18, 1995

[54] WRIST REST SUPPORT

[75] Inventors: Jon R. Rossman, Chelmsford; Bryan R. Hotaling, Arlington, both of Mass.

[73] Assignee: Curtis Manufacturing Company, Inc., Jaffrey, N.H.

[21] Appl. No.: 143,863

[22] Filed: Oct. 27, 1993

[51] Int. Cl.[6] ..... F16M 11/20

[52] U.S. Cl. ..... 248/118.1; 248/918; 400/715

[58] Field of Search ..... 248/118, 118.1, 118.3, 248/118.5, 918; 400/715

[56] References Cited

U.S. PATENT DOCUMENTS

| | | | |
|---|---|---|---|
| Re. 33,556 | 3/1991 | Berke | 248/118 X |
| 1,801,669 | 4/1931 | Hintz et al. . | |
| 3,300,250 | 1/1967 | Dollgener et al. | 248/118.1 |
| 4,331,360 | 5/1982 | Roudybush et al. | 248/118 X |
| 4,481,556 | 11/1984 | Berke et al. | 248/118 |
| 4,482,064 | 11/1984 | Berke et al. | 248/118 X |
| 4,621,781 | 11/1986 | Springer | 248/118 |
| 5,074,511 | 12/1991 | Wilson | 248/918 X |
| 5,125,606 | 6/1992 | Cassano et al. | 400/715 X |
| 5,163,646 | 11/1992 | Engelhardt | 248/118 |
| 5,197,699 | 3/1993 | Smith et al. | 248/118 |
| 5,234,186 | 8/1993 | Powell | 248/118.1 |
| 5,242,139 | 9/1993 | Aldrich | 248/118 |

*Primary Examiner*—Ramon O. Ramirez
*Attorney, Agent, or Firm*—Richard P. Crowley

[57] ABSTRACT

A wrist rest support for the wrist of a user engaged in repetitive motions of the fingers and hands, which wrist rest support comprises a support section having a top and bottom surface, the top surface having a surface area with a detachable, flexible, plastic wrist-cushioning sheet material thereon and a shape to provide support to the wrist of the user, a base section having a top surface to be detachably secured to the bottom surface of the support section, and a plurality of extending lugs on the support section and a plurality of lug-receiving spaces on the base section and aligned with and adapted to receive the lugs therein of the other section in a snug-fitting, detachable relationship to secure the support section to the base and to permit easy detachment of the sections from each other to enable the user to replace the flexible, plastic wrist-cushioning material if desired, and an outwardly extending planar section on the base section adapted to be grasped by the user for positioning the wrist rest support and for detaching the top section from the base section.

22 Claims, 2 Drawing Sheets

WRIST REST SUPPORT

BACKGROUND OF THE INVENTION

There are a wide variety of wrist rest supports known in the art for supporting and protecting the wrists of a user before a work station on a work surface. Generally, the purpose of the wrist rest support is to minimize injury or damage to the unsupported wrist of the operator, when the wrist of the user or operator is engaged in repetitive motions of the hand and fingers for long periods of time, which may, for example, lead to a widely recognized condition known as Carpal Tunnel Syndrome.

It is desired to provide for a new, improved wrist rest support which is simple to manufacture, assemble and use, which is inexpensive, and which provides for easy replacement of the cushioned sheet material employed with the wrist rest support and which support may be wholly integrally molded, except for the cushioned sheet material.

SUMMARY OF THE INVENTION

The present invention relates to a wrist rest support for use with a work station on a work surface and wherein the wrist of a user is engaged in repetitive motions of the hands and fingers.

The wrist rest support of the invention provides support for the wrist of the user engaged in repetitive motions of the hands and fingers and serves to prevent or reduce the onslaught of or damage relating to Carpal Tunnel Syndrome or other conditions, injuries or fatigues arising from repetitive use of the hands and fingers, which wrist rest support comprises a support section and a base section and optionally a detachable, replaceable wrist-cushioning sheet material over the top surface. The wrist rest support typically is composed of molded plastic support and base sections, with a flexible foam wrist-cushioning sheet material about the top surface area of the support section. The wrist rest comprises a support section having a top and bottom surface, the top surface having a surface area and a shape to provide support to the wrist of the user.

In one preferred embodiment, the support section has a top and bottom surface with the top surface having a top surface area and a curvilinear shape, typically an ellipsoidal shape, but may also have other shapes to provide suitable support to the wrist of the user, and with a bottom surface having a plurality of spaced-apart, downwardly extending cylinders having lug-receiving spaces therein. The base section preferably has a planar dimension generally matching the planar dimensions of the bottom of the support section, so as to serve as an adequate base. The base section has a generally flat top surface, with a plurality of spaced-apart, upwardly extending lugs, for example, multi-petaled or tapered lugs, the lugs adapted to be aligned with and be received with the respective aligned lug-receiving spaces of the support section, in a snug, friction-fitting manner, which provides for securing of the support section to the base for use by the user, and whereby the support section is detachably secured to the base section and may be removed easily to replace the flexible wrist rest sheet material used on the top surface area of the support section, and with the wrist rest support adapted in use by a user in front of a work station, such as a keyboard, placed on a table or desk top.

The wrist rest support of the invention is easily manufactured and assembled and used by a user, is composed of the base section and support section of integrally molded, hard plastic material, optionally and preferably with the support section having a top surface area having a detachable, removable, replaceable, cushion-type sheet material thereon, such as for example, a vinyl or rubber-foamed sheet material wrapped over the top surface area of the support section and extending to the bottom surface of the support section maintained in place by the secured base and support sections. The sheet material may be secured also with the aid of elongated, parallel ribs placed on the top surface of the base section and extended over the ribs. The wrist rest support of the invention provides for the employment of a flexible, cushion-type sheet material to be wrapped around the top surface area of the top section, and which flexible sheet material may be easily replaced by the user in use by detaching the support section from the base section by upward movement to overcome the engaged lugs in the lug-receiving spaces and then merely removing the flexible sheet material and wrapping a new flexible sheet material around the top surface area and extending the lower edges over elongated ribs on the base section, and then once again snugly securing the base section and support section together to stretch the flexible sheet material on the top surface area in a taut, useable condition.

The base section optionally has an outwardly extending handle section on one or both sides to provide typically an oval shape, or which may be of another shape, to provide means by which the user of the wrist rest support can position the wrist rest support in front of a work station. The support section has a top surface area, which may have a curvilinear shape which may vary as desired, to provide for the desired support of a wrist on the top surface area of the wrist support section. Generally, however, the support area would comprise a generally ellipsoidal shape to be covered by a thin, foam, flexible, sheet material to provide cushioning over the hard top surface area of the molded plastic of the support section. Generally, the support section may include slightly raised end sections at either end of the support section and which provides for retaining the flexible sheet material in position on the top surface area of the support section and provides lateral sliding or movement of the flexible sheet material when in place. The support section includes a plurality, typically two to six or more, downwardly-extending raised cylinders having typically cylindrical lug-receiving spaces, wherein the base section of the top surface has a matching plurality of upwardly extending lugs, typically multi-petal type lugs in one embodiment, which may be slightly tapered so that the lugs may be placed within the lug-receiving spaces in a tight fitting, friction-engaging manner, and yet may be easily removed by upward movement of the support section away from the base section by the user. The lugs or lug-receiving spaces may be in the base or support or both sections as desired.

The wrist rest support of the invention may be employed in combination with a work station such as a keyboard, or before a computer monitor, or with a mouse on a mouse pad, wherein the work station is placed on a work station surface such as a desk or table top, and with the wrist rest support placed before the work station and in a position to present a generally horizontal elongated surface on the top surface area of the support section aligned with the work station, and wherein typically the support section could be extended the length of the work station.

The wrist rest support of the invention thus has an easily molded support and base section of hard, molded, plastic material which only requires the addition of a separate, typically cushioned, sheet material for use with the support section and which may be easily assembled by the user by wrapping the flexible sheet material around the top surface area of the support section and yet permits easy disassembling by detaching the support and base sections when the flexible sheet material must be replaced during use. The flexible sheet material to be used may vary in composition and material, but typically extends to the length of the top support area, and generally is of a flexible, cushion-type material, such as a thin foam material, for example, of 2 to 20 mils, which may also contain or be treated to contain anti-static properties so that the flexible sheet material may be connected by electrical wires to a ground, to remove any static charge which may accumulate on the top area surface of the wrist rest support in use.

The base section preferably contains on the bottom surface rubber or anti-skid feet or means in order to prevent the lateral movement of the base section of the wrist rest support when placed on a work surface. In addition, the wrist rest support may optionally include a flexible sheet material, for example a vinyl foam sheet material containing carbon black therein to provide anti-static properties, and which may have a wire connected to the flexible sheet material, which wire is then connected by the user to a ground.

The invention will be described for the purposes of illustration only in connection with certain embodiments, however it is recognized that those persons skilled in the art may make various modifications, additions, changes and improvements to the illustrated embodiments without departing from the spirit and scope of the invention.

DESCRIPTION OF THE EMBODIMENTS

Figure 1:
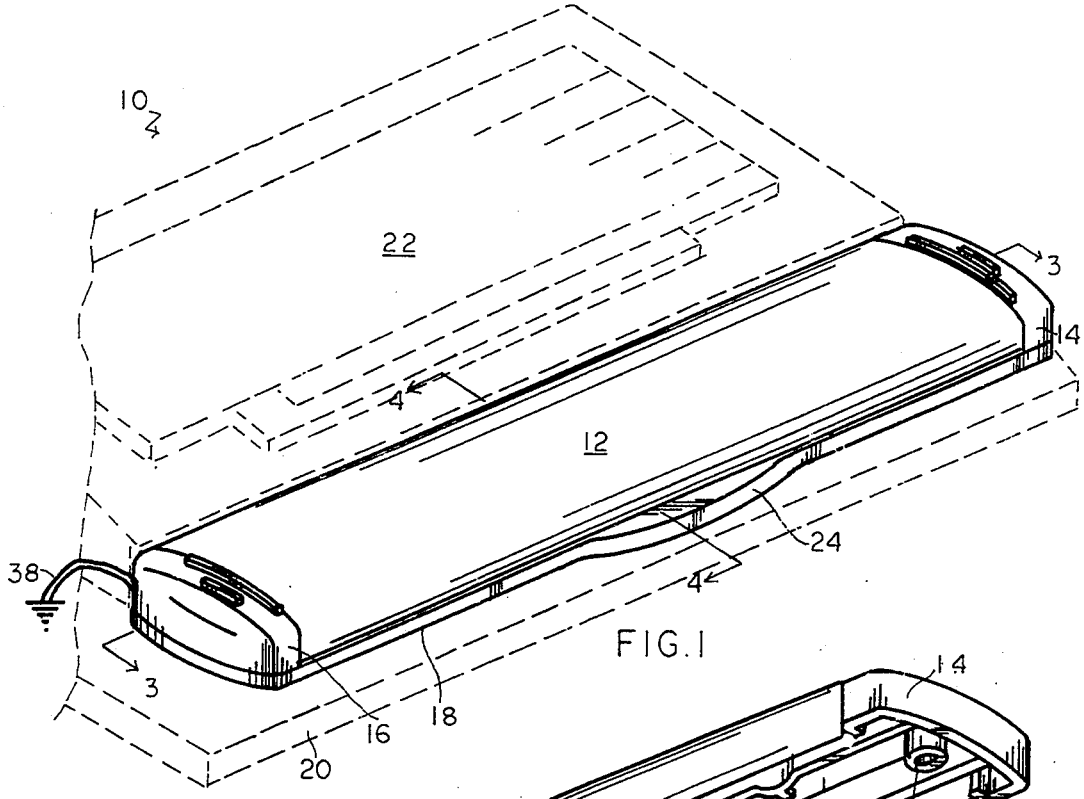
FIG. 1 is a perspective view from above of the wrist rest support of the invention with a partial drawing in broken lines of a computer keyboard and a desk top.
Figure 2:
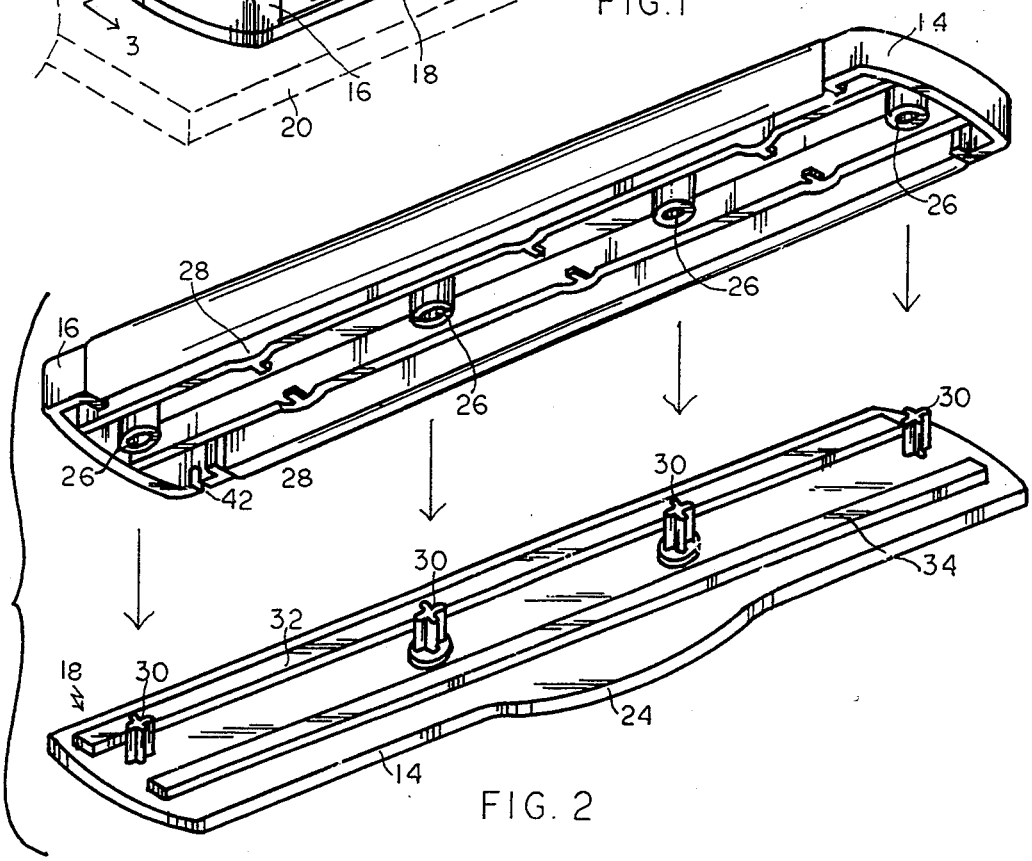
FIG. 2 is an exploded, perspective view of the top and bottom sections of the wrist rest of FIG. 1.
Figure 3:
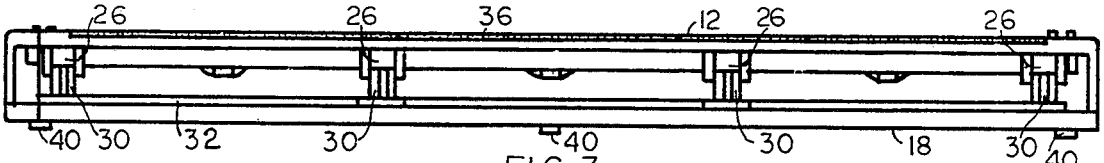
FIG. 3 is a side sectional view of the wrist rest of FIG. 1 along the line 3—3 of FIG. 1.
Figure 4:
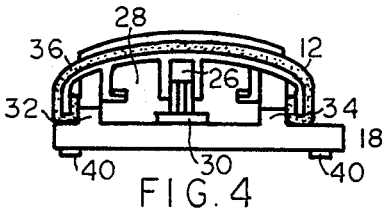
FIG. 4 is a side sectional view of the wrist rest of FIG. 1 along the line 4—4 of FIG. 1.
Figure 5:
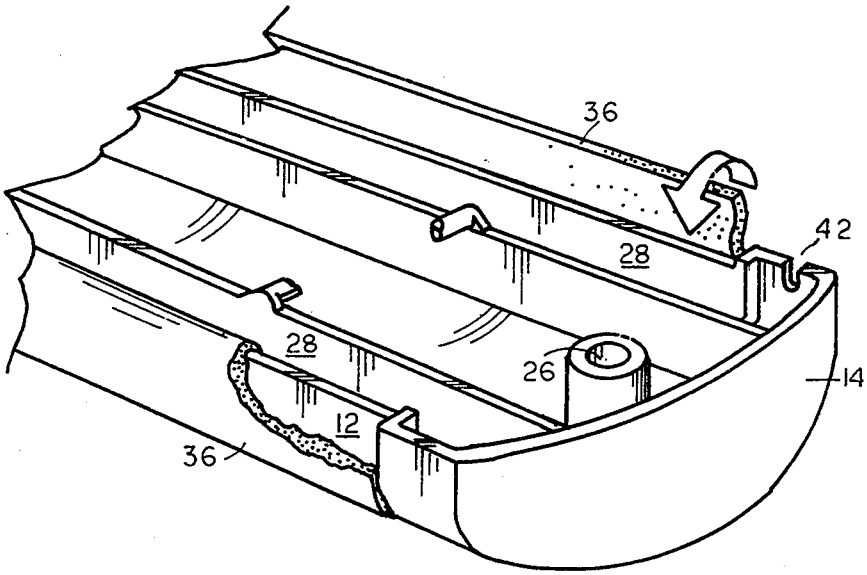
FIG. 5 is a partial, perspective, break-away view of the bottom of the top section of the wrist rest of FIG. 1.

FIG. 1 shows a wrist rest support system 10 which comprises a wrist rest support of the invention in a support section 12 and of a hard plastic and having a vinyl foam anti-static flexible sheet material 36 wrapped about the top surface area and extending between two slightly upwardly raised end sections 14 and 16 with the support section connected to a base section 18. The wrist rest support of the invention is illustrated in FIG. 1 in particular on a support surface 20 shown in dotted lines and before a work station 22 shown as a keyboard.

The base section 18 includes an outwardly extended, oval handle section 24 generally centrally positioned and extending toward the user, which permits grasping by the user of the wrist rest support so that it may be placed in front of the work station. As illustrated, the support section 12 includes on the bottom open surface thereof a plurality of downwardly-extended, generally uniform cylinders having cylindrical lug-receiving spaces 26 therein, having an elongated empty space 28 on either side of the lug-receiving spaces 26. The base section 18 includes a plurality of generally upwardly extended, plastic, molded lug elements 30 generally, as illustrated, multi-petaled, and which may be slightly tapered. The lug elements are adapted to be received in a line with the lug-receiving spaces 26 in the support section 12 and adapted to be frictionally engageable therein and removable therefrom. The base section 18 also includes integrally molded therein a pair of elongated rib elements 32 and 34 on either side of the lugs 30 and adapted to be received in the elongated empty spaces 28 in the support section 12. The ribs are adapted to help secure the outer edges of a flexible sheet cushioning wrist rest support material in he top surface area of the support section to be retained in place without the need for adhesive, that is to be frictionally engaged and held in place by the reinforcing ribs 32 and 34, to which the sheet material is placed and assembled by the user or for replacement by the user. The flexible sheet material employed in the top surface area is comprised in one embodiment as an anti-static, carbon particle-containing, vinyl foam, flexible sheet material 36 which is snugly placed over the top surface area of the support section 12 and extended between the end sections 14 and 16 and placed therebetween to prevent lateral movement and then the outer edges extended over the reinforcing ribs 34, and 32, so that when the base and the support section are frictionally engaged together the flexible sheet material 36 may be held firmly in place.

As illustrated in FIG. 1, the flexible sheet material 36 may also include where the material is anti-static, an extending wire 38 having a connector at the one end thereof, which connector may be secured to a ground connection to permit the drain-off of static charges during use of the wrist rest support. The bottom of the base section 18 may also and optionally include a plurality of rubber feet 40 as friction engaging elements to prevent the lateral movement of the wrist rest support on the work surface 20.

What is claimed is:

1. A wrist rest support for the wrist of a user engaged in repetitive motions of the fingers and hands, which wrist rest support comprises:

a) a support section formed of a molded plastic material having a top and an open bottom surface, the top surface having a surface area and a shape to provide support to the wrist of the user;

b) a base section formed of molded plastic material having a top surface;

c) detachable securing means which comprises a plurality of extending lugs on the top surface of the base section or the bottom surface of the support section and a plurality of lug-receiving spaces on the other respective base or support section surface and aligned with and adapted to receive the lugs therein of the other section in a snug-fitting, detachable relationship to secure the support section to the base section and to permit easy detachment of the sections from each other; and d) a flexible, wrist-cushioning sheet material which extends over the top surface area of the support section in a taut condition, and which sheet material extends into the open bottom surface of the support section and is secured in a removable manner between the bottom surface of the support section and the top surface of the base section.

2. The support of claim 1 wherein the base section has planar dimensions generally the same as the planar dimensions of the bottom surface of the support section.

3. The support of claim 1 wherein the base section includes a pair of spaced-apart, elongated rib elements secured to the top surface of the base section and wherein the support section includes a flexible, wrist-cushioning sheet material wrapped around the top surface thereof and over the top surface of the parallel rib elements, the rib elements placed to secure the flexible sheet material to the top surface.

4. The support of claim 1 wherein the base section has on one side thereof an outwardly extending planar section adapted to be grasped by the user for positioning the wrist rest support.

5. The support of claim 1 wherein the top surface area of the support section has a generally sectional ellipsoidal shape.

6. In a combination, a work station on a work surface and the wrist rest support of claim 1 positioned in front of the work station for use by a user.

7. The support of claim 1 wherein the flexible plastic sheet material comprises a generally rectangular foam plastic wrist-cushioning sheet material having opposite edges which extend over the top surface and to the bottom surface of the support section.

8. The support of claim 7 wherein the flexible plastic sheet material is detachably secured about the top surface area of the support and wherein the opposite edges are frictionally secured between the support and bottom sections without the use of adhesives.

9. The support of claim 1 wherein the lug-receiving spaces and the lugs comprise in number from about 2 to 6, and which lug-receiving spaces and lugs are generally uniformly spaced throughout the length of the respective aligned support section and base section.

10. The combination of claim 6 wherein the work station comprises a computer keyboard.

11. The support of claim 1 wherein the support section includes slightly raised end sections at either end of the support section, and which support section includes a flexible wrist-cushioning plastic sheet material placed on the top surface area of the support section and extending between the end sections.

12. The support of claim 1 wherein the sheet material has anti-static properties and includes a wire connection means for connection to a ground.

13. A wrist rest support for the wrist of a user engaged in repetitive motions of the fingers and hands, which wrist rest support comprises:

a) a support section of a molded plastic material having a top and bottom surface, the top surface having a top surface area and a curvilinear shape to provide support to the wrist of the user, and the bottom surface having a plurality of spaced-apart, downwardly extending lug-receiving spaces therein;

b) a base section of a molded plastic material having planar dimensions generally matching the planar dimensions of the bottom of the support section, and having a generally flat top surface with a plurality of spaced-apart, upwardly extending lugs, the lugs adapted to be aligned with and received in a friction fitting engaging manner within the lug-receiving spaces of the support section to secure the support section to the base section, whereby the support section is detachably secured to the base section and may be positioned in use by a user in front of a work station;

c) the support section having raised end sections at either end; and d) a detachable, flexible, wrist-cushioning sheet material having outer edges and extending generally in a taut condition over the top surface area of the support section and generally between the end sections and secured detachably between the bottom surface of the support section and the top surface of the base section.

14. The support of claim 13 wherein the base section has an outwardly extending, generally centrally positioned oval section on one side to permit the oval section to be grasped by a user.

15. The support of claim 13 wherein the base section includes a pair of elongated rib elements on either side and the support section includes an elongated rib receiving space to receive the elongated ribs of the base section, the ribs receiving the outer edges of the wrist-cushioning sheet material to engage frictionally the wrist cushioning sheet material in a taut condition without adhesive on the top surface of the support section.

16. The support of claim 13 wherein the wrist-cushioning sheet material comprises an anti-static, carbon particle-containing, foam sheet material and wire grounding means to connect the anti-static sheet material to a ground in use.

17. A wrist rest support for the wrist of a user engaged in repetitive motions of the fingers and hands, which wrist rest support comprises:

a) a single support section integrally formed of a molded, hard plastic material having a top surface and a bottom surface, the top surface having a surface area and shape to provide support to the wrist of the user;

b) a single base section integrally formed of a molded, hard plastic material having a generally flat bottom surface and a top surface, the base section having planar dimensions generally the same as the planar dimensions of the bottom surface of the support section;

c) detachable securing means which comprises a plurality of spaced apart, generally vertically extending, tapered lugs on the top surface of the base section or the bottom surface of the support section, and a plurality of lug-receiving spaces on the other respective base section or support section and aligned with and adapted to receive the lugs therein in a snug, detachable, friction-engaging relationship to secure in a releasable manner the support section to the base section; and d) a flexible, wrist-cushioning sheet material extending over and secured to the top surface area of the support section.

18. The support of claim 17 wherein the lugs are positioned on the top surface of the base section and are generally uniformly spaced apart substantially along the length of the base section.

19. The support of claim 17 wherein the lugs are generally multipetal lugs, and the lug-receiving spaces are generally cylindrical spaces.

20. The support of claim 17 which includes raised end sections at either end of the support section.

21. The support of claim 17 wherein the base section has an open bottom surface and the sheet material extends over tho top surface area and into the open bottom surface and is detachably retained in a taut condition over the top surface area between the secured base section and the support section.

22. The support of claim 17 wherein the base section includes a generally centrally positioned, outwardly extending, planar section on one side adapted to be grasped by the user for positioning the wrist rest support.

* * * * *